United States Patent [19]

Karal

[11] 4,361,922

[45] Dec. 7, 1982

[54] CLEANING BRUSH FOR ELECTROSTATIC COPIERS, PRINTERS AND THE LIKE

[75] Inventor: Donald W. Karal, Rochester, N.Y.

[73] Assignee: Schlegel Corporation, Rochester, N.Y.

[21] Appl. No.: 222,878

[22] Filed: Jan. 6, 1981

[51] Int. Cl.[3] ..... G03G 21/00

[52] U.S. Cl. ..... 15/1.5 R; 15/256.52; 118/652; 355/15

[58] Field of Search ..... 15/1.5, DIG. 6, 256.52, 15/159 A, 179; 355/15; 118/652

[56] References Cited

U.S. PATENT DOCUMENTS

| | | | |
|---|---|---|---|
| 2,733,465 | 2/1956 | Holt | 15/1.5 R X |
| 3,186,019 | 6/1965 | Hattori | 15/179 |
| 3,237,233 | 3/1966 | Adams . | |
| 3,610,693 | 10/1971 | Solarek . | |
| 3,893,416 | 7/1975 | Eichorn . | |
| 3,909,864 | 10/1975 | Tanaka et al. . | |
| 3,969,090 | 7/1976 | Sasena | 15/159 A |
| 4,095,980 | 6/1978 | Satomi . | |
| 4,123,154 | 10/1978 | Fisher . | |
| 4,185,910 | 1/1980 | Nomura et al. . | |
| 4,295,239 | 10/1981 | Myochia . | |
| 4,304,026 | 12/1981 | Borostyan . | |

FOREIGN PATENT DOCUMENTS

| | | | |
|---|---|---|---|
| 2403603 | 8/1974 | Fed. Rep. of Germany | 15/159 A |
| 309419 | 4/1929 | United Kingdom | 15/159 A |

*Primary Examiner*—Edward L. Roberts

*Attorney, Agent, or Firm*—Cushman, Darby & Cushman

[57] ABSTRACT

A cleaning brush for dry electrostatic copiers and printers is provided with two or more types of bristles, one of which is made from a conductive material, the other types to be made from non-conductive materials; the conductive bristles are all of equal or shorter length in relationship to the non-conductive bristles.

17 Claims, 3 Drawing Figures

CLEANING BRUSH FOR ELECTROSTATIC COPIERS, PRINTERS AND THE LIKE

BACKGROUND AND SUMMARY OF THE INVENTION

The present invention relates to cleaning brushes for electrostatic copiers of the type utilizing photoreceptors, usually in the form of a rotatable drum or film type belts, zinc oxide, mylar, cadmium, etc., onto which toner particles are electrostatically deposited and which must be removed after each copy has been produced.

In the prior art relating to electrostatic copying machines, it has long been known that adequate means must be provided in the apparatus for removing toner particles from the photoconductive surface in a development station of such copiers and printers. For the most part, such stations employ rotating drums or belts onto which the toner particles are electrostatically deposited and carried through a printing cycle. The surface of such drums or belts have come to be made from a highly polished photosensitive material such as silenium, copper, etc., for drums and zinc oxide, mylar, cadmium, etc., for belts. Extreme care must be taken to keep the surfaces of these drums and belts very clean and protect them from fogging or scratching to insure good reproduction of copies through a large number of printing cycles. Thus, it is important that, after each printing cycle, any remaining toner particles be completely removed from the photosensitive surface without causing any damage or similarly introducing any contaminants to affect the surface of the photoreceptor.

To this end, the prior art has suggested a number of cleaning devices which have employed elaborate air venting and vacuuming implements as well as various types of brushes, many of which have been electrically or magnetically treated with chemicals, sprays, or the like, etc., to assist in the pick-up and removal of toner particles. While such devices have been useful in electrostatic copiers, the efficiency of the cleaning cycle has required improvement so as to minimize the downtime for the copying machine and reduce the frequency of required product maintenance changes.

To this end, the present invention provides an improved cleaning brush for the removal of toner and other particles from a photosensitive surface where, in a preferred embodiment, the brush is formed with two or more kinds of bristles. One kind is a conductive material while the others are compatible non-conductive materials wherein the conductive material fibers may be of shorter or comparable length relative to the non-conductive bristles. Also, in the preferred embodiment, the conductive and non-conductive bristles are intermingled and are supported to extend radially from a cylindrical core which is at least partially conductive or capable of transferring electrical charge throughout. Means may be provided to change the polarity of the conductive bristles to positive or negative alternately while cycling if necessary by connecting the core to a direct current source of the desired polarity or to ground or apply an alternating potential (∿) to the brush which would in effect neutralize the surrounding air to encourage the cleaning process.

The combination of conductive and non-conductive bristles, where the conductive bristles are shorter or of comparable length relative to the non-conductive fibers, will provide an optimum cleaning process and result in a reduction in the frequency of required machine maintenance.

The foregoing and other advantages of the present invention will become apparent as consideration is given to the following detailed description taken in conjunction with the accompanying drawings, in which:

DETAILED DESCRIPTION OF THE INVENTION

Figure 1:
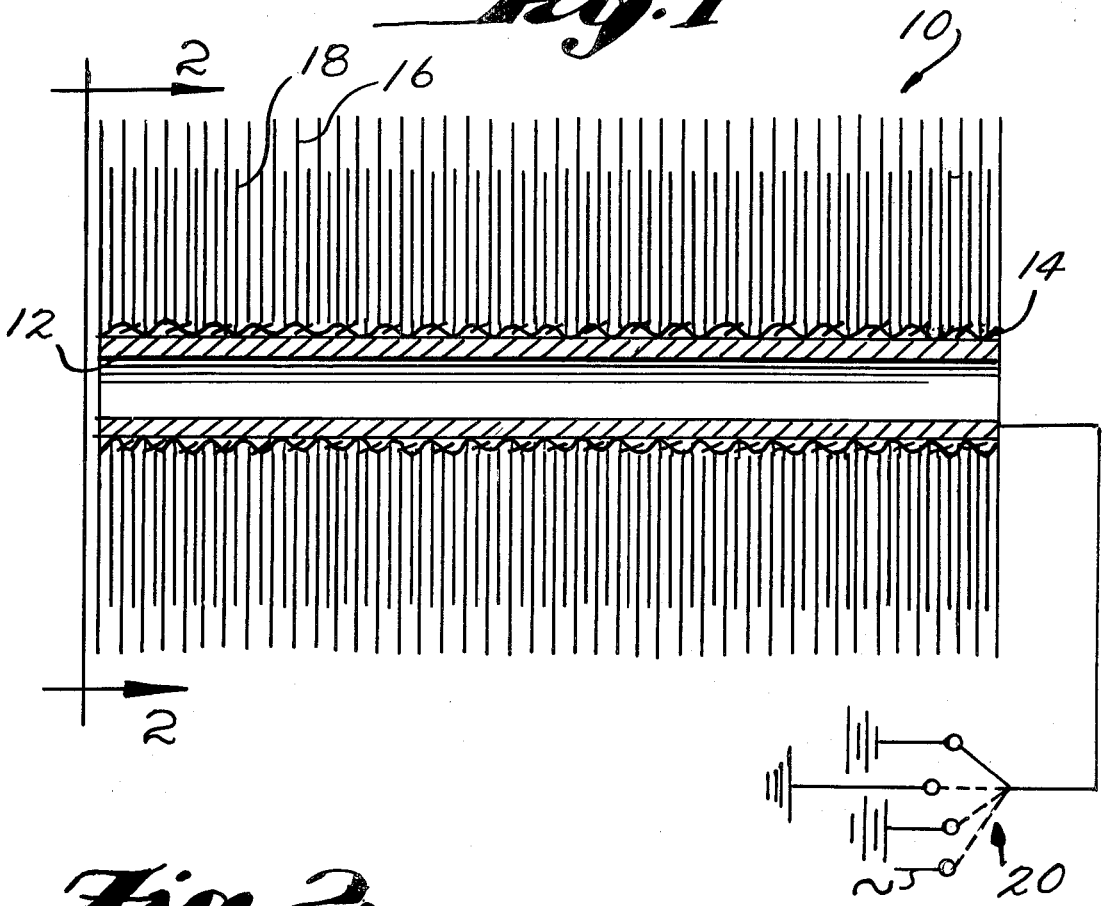
FIG. 1 is a sectional view in elevation of one embodiment of the brush of the present invention.
Figure 2:
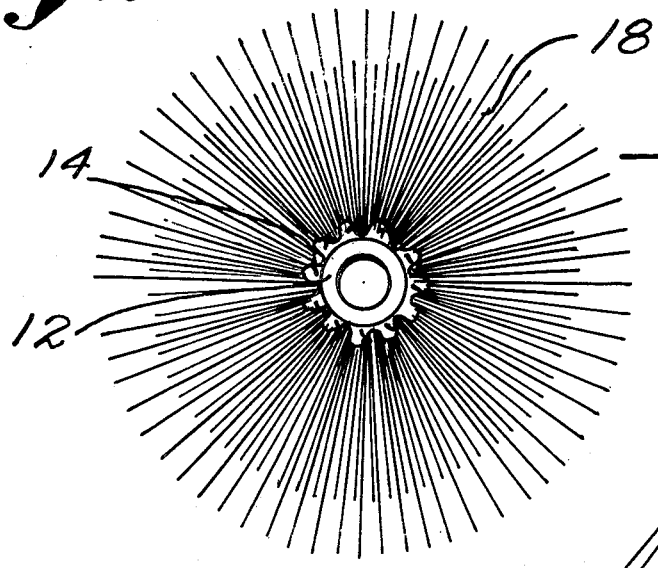
FIG. 2 is an end view taken along lines 2—2 of FIG. 1.

Referring now to the drawings wherein like numerals designate corresponding parts throughout the several views, there is illustrated in FIG. 1 a schematic illustration of one embodiment of the brush 10 of the present invention. In this embodiment, the brush 10 includes a core 12 which may be a metal cylinder or other material coated or treated which is conductive per se or connected through wiring clips, or similar methods, to a conductive surface and on which is mounted a sleeve fabric 14 as may be more clearly seen in the sectional view of FIG. 2. The sleeve 14 is essentially a woven, knitted, tufted or similarly formed fabric from which bristles protrude generally as illustrated.

According to the present invention, bristles of the brush 10 are provided in two or more separate mixtures. One or more types such as at 16 may be woven, knitted or tufted into the fabric 14 so as to protrude at a selected length from the surface of the fabric 14. These are generally non-conductive fibers such as rayon, modacrylic, fluorocarbon, polyester, acrylic, nylon, polypropylene, glass, orlon, cotton, wool or the like. One type 18 of bristles is made from any conductive material such as steel, aluminum, copper, graphite, carbon or conductive coated yarns such as aluminum, silver, carbon or similar coated nylons, rayon, etc., or the like all in filament or staple form so as to be able to be woven, knitted or tufted into the fabric 14 and to protrude therefrom in the form of the bristles as illustrated. Also, the conductive type of bristles 18 may include basic non-conductive filaments as described above which have been coated with one of the conductive metals.

Figure 3:
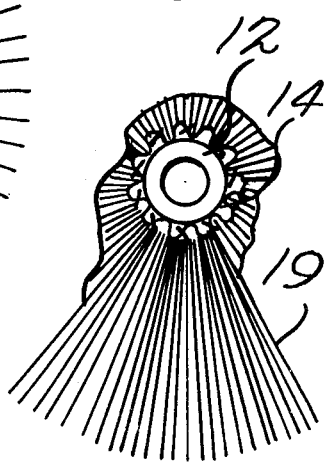
FIG. 3 is an end view with parts broken away showing another embodiment of the present invention.

Preferably, in forming the fabric, the conductive bristles 18 are of shorter length than the non-conductive set of bristles 16 although, in some applications, the bristles may be of equal length such as is illustrated in FIG. 3 at 19. Preferably, the conductive and non-conductive bristles are intermingled over the surface area of the fabric sleeve 14 and such intermingling may be random or according to a selected pattern. The length of the bristles, measured from the outer circumference of the sleeve 12 depends, of course, on the particular machine structure in which the brush 10 is to be incorporated, as will be evident to those skilled in this art. A length difference between the conductive and non-conductive bristles from equal to approximately ⅛" should be satisfactory for most applications.

While in the preferred embodiment, the bristles extend radially from the cylinder core 12, it will also be apprent to those skilled in this art that a flat brush may also be employed as may be dictated by the structure of the particular photocopier in which the brush 10 is installed.

Means may also be provided for changing the positive, negative, neutral ground or alternating potential (∿) to core 12 and, as a result, of the conductive bristles 18 with which the core is in electrical contact. For example, switching means 20 may be employed to impart a positive, negative or neutral polarity to the core 12 automatically.

In many cases, the base of the fabric 14 may be provided with a conductive coating to assure good electrical contact between the fabric 14, the bristles 18 and the core 12.

In forming the fabric 14, at least 50 percent of the bristles should be of the non-conductive type since these bristles are more likely to come into direct contact with the surface of the photosensitive element and effect mechanical removal of a majority of the particles carried thereby. The conductive bristles 18 attract the toner particles when of opposite polarity concurrently or after the non-conductive bristles 16 have lifted the toner particles from the drum or belt surface.

It will be apparent that, instead of using a conductive core 12, the switching means 20 may be connected to the fabric sleeve 14 which itself would be made electrically conductive by a suitable conductive coating applied to the inner and/or outer and end surfaces of the core and on the fabric as noted above and as will be apparent to those skilled in this art. This coating can also be adhesive to secure it to the core. In this case, conductive means such as metal clips or wires would be used to connect the switching means 20 to the fabric sleeve 14.

Having described the invention, it will be apparent that various modifications may be made thereto without departing from the spirit and scope of the present invention as defined in the appended claims:

1. A cleaning brush for removing particles from a photosensitive surface, some of which particles are electrically conductive, comprising a first type of bristles of a selected length made from electrically non-conductive material and a second type of bristles which are shorter than said bristles of said selected length and which are made of an electrically conductive material, both types of said bristles being formed with a fabric base with the bristles of one type intermingled with the bristles of the other type, said fabric base being mounted on a support means, said support means being electrically conductive and switch means being provided for changing the electrical polarity of said support means between positive, neutral and negative polarity.

2. The brush as claimed in claim 1 wherein said support means is a cylindrical core and the bristles of said types extend radially from said core.

3. The brush as claimed in claim 1 wherein the bristles of said first type are a synthetic fiber.

4. The brush as claimed in claim 1 wherein the bristles of said second type are metal fibers.

5. The brush as claimed in claim 4 wherein said conductive bristles are carbon.

6. The brush as claimed in claim 4 wherein said conductive bristles are silver coated synthetic fibers.

7. The brush as claimed in claim 4 wherein said conductive bristles are carbon coated synthetic fibers.

8. The brush as claimed in claim 1 wherein the bristles of said second type are non-conductive fibers.

9. The brush as claimed in claim 1 wherein said bristles of said first type are approximately fifty percent of the bristles of said brush based on the percentage required to maintain proper polarity to attract toner particles.

10. The brush as claimed in claim 1 wherein said bristles of said first type are natural fibers.

11. The brush as claimed in claim 1 wherein said conductive bristles are natural fibers coated with a conductive metallic material.

12. The brush as claimed in claim 1 wherein said fabric base is a woven fabric.

13. The brush as claimed in claim 1 wherein said fabric base is a knitted fabric.

14. The brush as claimed in claim 1 wherein said fabric base is a tufted fabric.

15. The brush as claimed in claim 1 wherein said fabric base is coated with a conductive coating on the under side opposite the bristle ends.

16. The brush as claimed in claim 1 wherein said fabric base is applied with a conductive adhesive to said support means.

17. A cleaning brush for removing particles from a photosensitive surface, some of which particles are electrically conductive, comprising a first type of bristles of a selected length made from electrically non-conductive material and a second type of bristles which are shorter than said bristles of said selected length and which are made of an electrically conductive material, both types of said bristles being formed with a fabric base with the bristles of one type intermingled with the bristles of the other type, said fabric base being mounted on a support means, said support means being electrically conductive and being connected to an electrical ground.

* * * * *